US008737900B2

(12) United States Patent
Sato

(10) Patent No.: US 8,737,900 B2
(45) Date of Patent: May 27, 2014

(54) CLEANING MEMBER

(75) Inventor: Hiroshi Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 13/388,175

(22) PCT Filed: Dec. 8, 2010

(86) PCT No.: PCT/JP2010/072508

§ 371 (c)(1),
(2), (4) Date: Jan. 31, 2012

(87) PCT Pub. No.: WO2011/071180

PCT Pub. Date: Jun. 16, 2011

(65) Prior Publication Data

US 2012/0128394 A1 May 24, 2012

(30) Foreign Application Priority Data

Dec. 11, 2009 (JP) ..... 2009-282027

(51) Int. Cl.
*G03G 21/00* (2006.01)

(52) U.S. Cl.
USPC ..... 399/351; 399/350

(58) Field of Classification Search
USPC ..... 399/350, 351
See application file for complete search history.

(56) References Cited

U.S. PATENT DOCUMENTS

| | | | | |
|---|---|---|---|---|
| 3,848,992 A * | 11/1974 | Smith | 399/350 | |
| 6,253,044 B1 * | 6/2001 | Shoji et al. | 399/111 | |
| 6,640,081 B2 | 10/2003 | Sato | | |

FOREIGN PATENT DOCUMENTS

| | | | | |
|---|---|---|---|---|
| JP | 59-182483 A | | 10/1984 | |
| JP | 59182483 A | * | 10/1984 | G03G 21/00 |
| JP | 59-214069 A | | 12/1984 | |
| JP | 3-284784 A | | 12/1991 | |
| JP | 2005-164774 A | | 6/2005 | |
| JP | 2007-232759 A | | 9/2007 | |

OTHER PUBLICATIONS

Notification of Transmittal (Form PCT/ISA/220) mailed Mar. 4, 2011, forwarding International Search Report (Form PCT/ISA/210) and the Written Opinion (Form PCT/ISA/237), in International Application No. PCT/JP2010/072508, filed Dec. 8, 2010.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A cleaning member, for use in an image forming apparatus in which a developer image formed on an image bearing member is to be transferred onto a developer image receiving member to form an image, for removing a developer remaining on the image bearing member after the transfer includes an elastic blade portion, having flexibility, for removing the developer remaining on the image bearing member in contact with the image bearing member in a bent state; and a supporting portion for supporting the elastic blade portion. The elastic blade portion includes, in a cross section perpendicular to a longitudinal direction of the elastic blade at a position in which the developer image is to be formed with respect to the longitudinal direction, a contact portion contacted to the image bearing member when the cleaning member is used in the image forming apparatus, a first connecting portion for connecting the contact portion and a portion of the supporting portion close to the image bearing member, and a second connecting portion for connecting the contact portion and a portion of the supporting portion remote from the image bearing member. The supporting portion, the contact portion, the first connecting portion and the second connecting portion define a hollow area.

11 Claims, 6 Drawing Sheets

(a)

(b)

CLEANING MEMBER

TECHNICAL FIELD

The present invention relates to a flexible cleaning member for removing a developer on an image bearing member by contacting the image bearing member.

BACKGROUND ART

In an image forming apparatus such as a printer, a latent image is formed on a photosensitive drum, as the image bearing member which has been uniformly charged, by effecting selective light exposure and the latent image is visualized with toner as the developer to form a toner image, and then the toner image is transferred onto a recording material to effect image recording. After the toner image is transferred, a surface of the photosensitive drum is cleaned by the cleaning member and prepared for subsequent image formation. As a cleaning means for cleaning the photosensitive drum surface, a cleaning device for cleaning the photosensitive drum surface by bringing an elastic blade consisting of a rubber or the like as the cleaning member into contact with the photosensitive drum surface has been known (e.g., Japanese Laid-Open Patent Application (JP-A) 2005-164774). As the developer, in recent years, the toner which has been downsized and/or sphered in order to realize high definition and high quality is used.

With respect to setting during mounting of the cleaning member in the cleaning device, the cleaning member is disposed so as to assume a phantom straight shape of the photosensitive drum in an unloaded condition free from the photosensitive drum to obtain a desired contact pressure. However, particularly in the case where the above-described toner which has been downsized and sphered is used, the toner is liable to pass through the cleaning member and therefore a problem that a setting image in which the cleaning is satisfactorily performed is narrow, occurs. As a result, part accuracy is required and thus an improvement is desired.

DISCLOSURE OF THE INVENTION

The present invention has been accomplished in view of the circumferences described above. A principal object of the present invention is to provide a small-sized cleaning member capable of realizing stable cleaning.

According to an aspect of the present invention, there is provided a cleaning member, for use in an image forming apparatus in which a developer image formed on an image bearing member is to be transferred onto a developer image receiving member to form an image, for removing a developer remaining on the image bearing member after the transfer, the cleaning member comprising:

an elastic blade portion, having flexibility, for removing the developer remaining on the image bearing member by contacting the image bearing member in a bent state; and a supporting portion for supporting the elastic blade portion, wherein the elastic blade portion includes, in a cross section perpendicular to a longitudinal direction of the elastic blade at a position in which the developer image is to be formed with respect to the longitudinal direction, a contact portion contacted to the image bearing member when the cleaning member is used in the image forming apparatus, a first connecting portion for connecting the contact portion and a portion of the supporting portion close to the image bearing member, and a second connecting portion for connecting the contact portion and a portion of the supporting portion remote from the image bearing member, and wherein the supporting portion, the contact portion, the first connecting portion and the second connecting portion define a hollow area.

According to another aspect of the present invention, there is provided a cleaning member, for use in an image forming apparatus in which a developer image formed on an image bearing member is to be transferred onto a developer image receiving member to form an image, for removing a developer remaining on the image bearing member after the transfer, the cleaning member comprising:

an elastic blade portion, having flexibility, for removing the developer remaining on the image bearing member by contacting the image bearing member in a bent state; and a supporting portion for supporting the elastic blade portion, wherein the elastic blade portion includes, in a cross section perpendicular to a longitudinal direction of the elastic blade at a position in which the developer image is to be formed with respect to the longitudinal direction, a contact portion contacted to the image bearing member when the cleaning member is used in the image forming apparatus, a first connecting portion for connecting the contact portion and a portion of the supporting portion close to the image bearing member, a second connecting portion for connecting the contact portion and a portion of the supporting portion remote from the image bearing member, and a foam member provided in an area defined by the supporting portion, the contact portion, the first connecting portion, and wherein the foam member is softer than the image connecting portion and the second connecting portion.

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

Hereinbelow, embodiments for carrying out the present invention will be described specifically in an exemplary manner with reference to the drawings. However, dimensions, materials, shapes, relative positions of constituent elements described in the following embodiments may be appropriately changed depending on constitutions and various conditions of members (apparatuses) to which the present invention is applied and therefore the scope of the present invention is not limited to those described in the following embodiments.

The present invention relates to an image forming apparatus, such as a copying machine or a laser printer, of an electrophotographic type or an electrostatic recording type, in which an image is formed on a recording material. Particularly, the present invention relates to a flexible cleaning member for removing a developer on an image bearing member in contact with the image bearing member.

Embodiment 1

Figure 2:
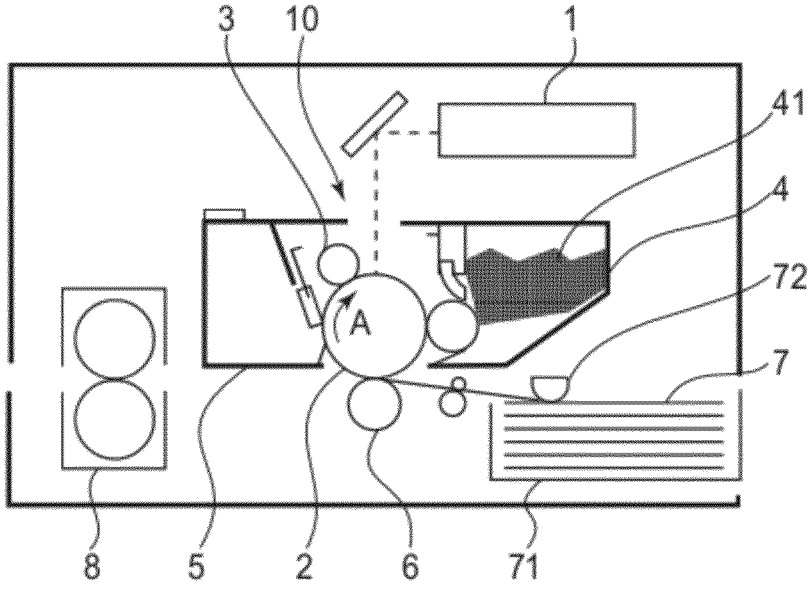
FIG. 2 is a schematic sectional view of an image forming apparatus in Embodiment 1.

FIG. 2 is a schematic sectional view showing the image forming apparatus in this embodiment. An image forming operation of the image forming apparatus will be described.

Laser light modulated depending on an image signal is outputted in a scanning manner from a scanner unit 1 including a laser, a polygon mirror and a lens system, so that a surface of a photosensitive drum 2 as the image bearing member is irradiated with the laser light. The photosensitive drum 2 is uniformly charged by a primary charger 3 including a charging roller, so that an electrostatic latent image is formed on the surface of the photosensitive drum 2 by the irradiation with the laser light. The electrostatic latent image is developed with a toner 41 as the developer in a developing device 4, thus being visualized as a toner image (developer image). On the other hand, a recording material (toner (developer) image receiving member) 7 accommodated in a cassette 71 is fed and conveyed by a feeding roller 72 to a transfer charger 6 including a transfer roller in synchronism with the latent image formation on the photosensitive drum 2 and then, the toner image is transferred from the photosensitive drum 2 onto the recording material 7 by the transfer charger 6. The recording material 7 on which the toner image is transferred is conveyed into a fixing device 8, by which the toner image is permanently fixed on the recording material 7. Thereafter, the recording material 7 is discharged to the outside of the image forming apparatus.

The toner remaining on the photosensitive drum 2 after the transfer is removed (subjected to cleaning) by a cleaning device 5 including an elastic blade portion 58 having flexibility. In the cleaning device 5, the elastic blade portion 58 contacts the photosensitive drum 2 in a bent state, so that the toner remaining on the photosensitive drum 2 is removed. Here, the primary charger 3, the developing device 4 and the transfer charger 6 constitute an image forming portion (image forming means) 10.

Figure 1:
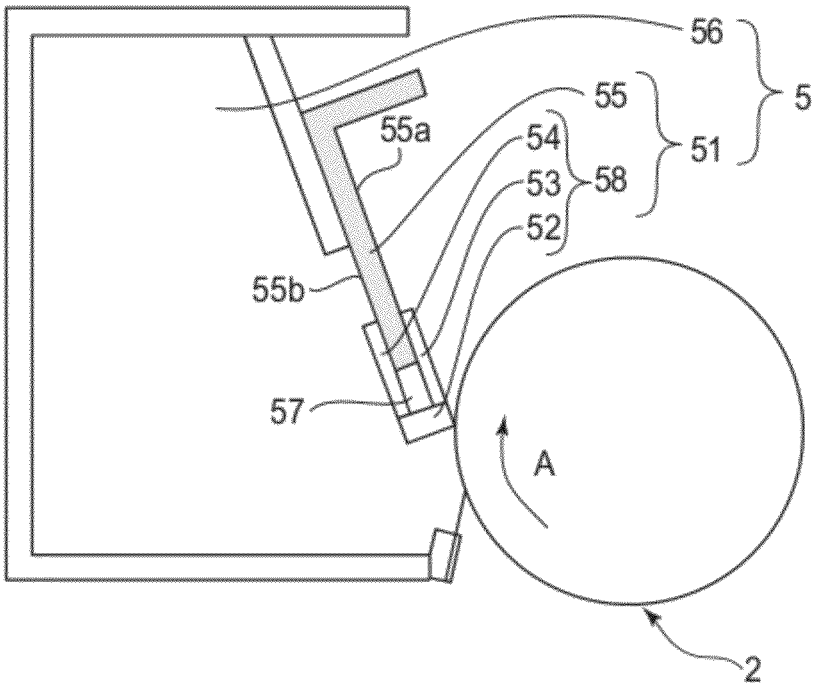
FIG. 1 is a schematic sectional view of a cleaning device in Embodiment 1.

The cleaning device 5 to which the present invention is applied will be described with reference to FIG. 1. FIG. 1 is a schematic sectional view of the cleaning device 5 in this embodiment.

The cleaning device 5 includes a cleaning member 51 to be contacted to the photosensitive drum 2 counterdirectionally to a rotational direction indicated by an arrow A of the photosensitive drum 2 and includes a residual toner container 56 for containing residual toner removed from the surface of the photosensitive drum 2 by the cleaning member 51.

The cleaning member 51 includes the elastic blade portion 58 and a supporting portion (supporting member) 55 and is held relative to the photosensitive drum 2 with a predetermined positional relationship. In a cross section perpendicular to a longitudinal direction of the elastic blade portion 58, the elastic blade portion 58 is constituted by a contact portion (contact member) 52, a first connecting portion (connecting member) 53 and a second connecting portion (connecting member) 54. Further, a hollow area 57 is formed and defined by the supporting portion 53, the contact portion 52, the first connecting portion 53 and the second connecting portion 54. Incidentally, the cross section is taken at a position in which the developer (toner) image is formed on the photosensitive drum 2 with respect to the longitudinal direction of the elastic blade portion 58. The longitudinal direction of the elastic blade portion 58 corresponds to a rotational axis direction of the photosensitive drum 2 and a widthwise direction of the recording material and is perpendicular to a recording material conveyance direction. The supporting portion 55 supports the entire cleaning member 58. The contact portion 52 is contacted to the photosensitive drum 2 and is formed with an elastic member. The image connecting portion 53 connects the supporting portion 55 and the contact portion 52 on a side where the elastic blade portion 58 is close to the photosensitive drum 2, and is formed with an elastic member. In this embodiment, the first connecting portion 53 connects the contact portion 52 and a first surface 55*a* of the supporting portion 55 as a portion close to the photosensitive drum 2. Further, the second connecting portion 54 connects the supporting portion 55 and the contact portion 52 on a side where the elastic blade portion 58 is remote from the photosensitive drum 2, and is formed with the elastic member. In this embodiment, the second connecting portions 54 connects the contact portion 52 and a second surface 55*b* of the supporting portion 55 as a portion remote from the photosensitive drum 2.

Figure 3:
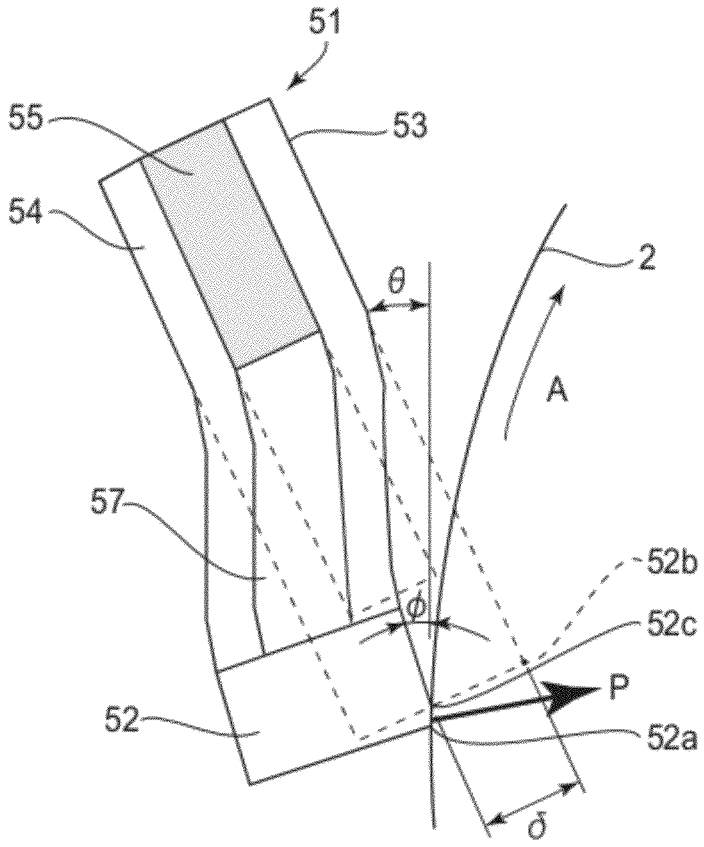
FIG. 3 is a schematic view for illustrating a state in which a cleaning member contacts a photosensitive drum.

Then, a contact state of the cleaning member 51 with the photosensitive drum 2 will be described with reference to FIG. 3. FIG. 3 is a schematic sectional view for illustrating the contact state of the cleaning member 51 with the photosensitive drum 2.

The cleaning member 51 is fixed so that a contact edge and the photosensitive drum 2 have a predetermined positional relationship in an unloaded state of the cleaning member 51 (indicated by a broken line in FIG. 3), i.e., is fixed at a position determined by an entering amount (penetration depth) $\delta$ and a set angle $\theta$. Here, the entering amount $\delta$ is a length, in the unloaded state of the cleaning member indicated by the broken line in FIG. 3, from a point 52*c* of intersection of the contact portion 52 (broken line) and an outer peripheral surface of the photosensitive drum 2 to a contact edge 52*b* in the unloaded state. The contact edge 52*b* is an edge of the contact portion 52 in the unloaded state when the cleaning member 51 is virtually caused to enter the photosensitive drum 2. Further, the set angle $\theta$ is formed between the first connecting portion 53 (solid line) and a tangent line of the outer peripheral surface of the photosensitive drum 2 passing through the point 52*c* in the unloaded state of the cleaning member 51 indicated by the broken line in FIG. 3. When the cleaning member 51 and the photosensitive drum 2 are mounted at predetermined positions in the image forming apparatus, the contact portion 52 and the first and second connecting portions 53 and 54 of the cleaning member 51 are deformed, so that a contact edge 52*a* contacts the surface of the photosensitive drum 2 at a contact angle $\phi$ with a contact pressure P. Here, the contact angle $\phi$ is formed between the tangent line of the outer peripheral surface of the photosensitive drum 2 passing through the contact edge 52*a* contacting the photosensitive drum 2 and the contact portion 52 or the first connecting portion 53 in the neighborhood of the contact edge 52*a*.

The present inventor has found through an experiment that a contact state of the contact portion 52 determined by the contact pressure P and the contact angle ϕ may only be required to be in a predetermined range in order to realize stable and good cleaning performance. Here, in the case where the contact pressure is excessively low, a force for scraping (removing) the toner deposited on the drum surface becomes small, so that there is a possibility that the toner passes through the elastic blade to cause defective cleaning. On the other hand, in the case where the contact pressure is excessively large, particularly in the case where the contact pressure is increased by increasing the entering amount, the contact angle becomes small and thus a contact area between the photosensitive drum 2 surface and the contact portion 52 is increased. For this reason, there is a possibility that the pressure applied to the abutment edge is relatively decreased and thus the toner passes through the contact portion 52 to cause the defective cleaning. Further, in the case where the contact pressure is increased by the thickness and elastic property of the cleaning member 51, there is a possibility that an increase in torque and an increase in scraped amount are caused.

Further, in the case where the contact angle is excessively small, as described above, there is a possibility that the toner passes through the elastic blade. On the other hand, in the case where the contact angle is excessively high, the contact area between the photosensitive drum 2 surface and the contact portion 52 becomes insufficient, so that there is a possibility that the toner passes through the elastic blade.

In view of the above points, the present inventor has made a study on a setting condition (entering amount and set angle) of the cleaning member 51 with respect to the photosensitive drum 2 during the mounting and on a contact condition of the contact portion 52 with respect to the surface of the photosensitive drum 2 by using structural analysis through finite element method. As a result, the present inventor has found that the predetermined contact condition can be satisfied under a set condition in a wider range by forming the elastic blade in a particular shape in cross section.

Figure 4:
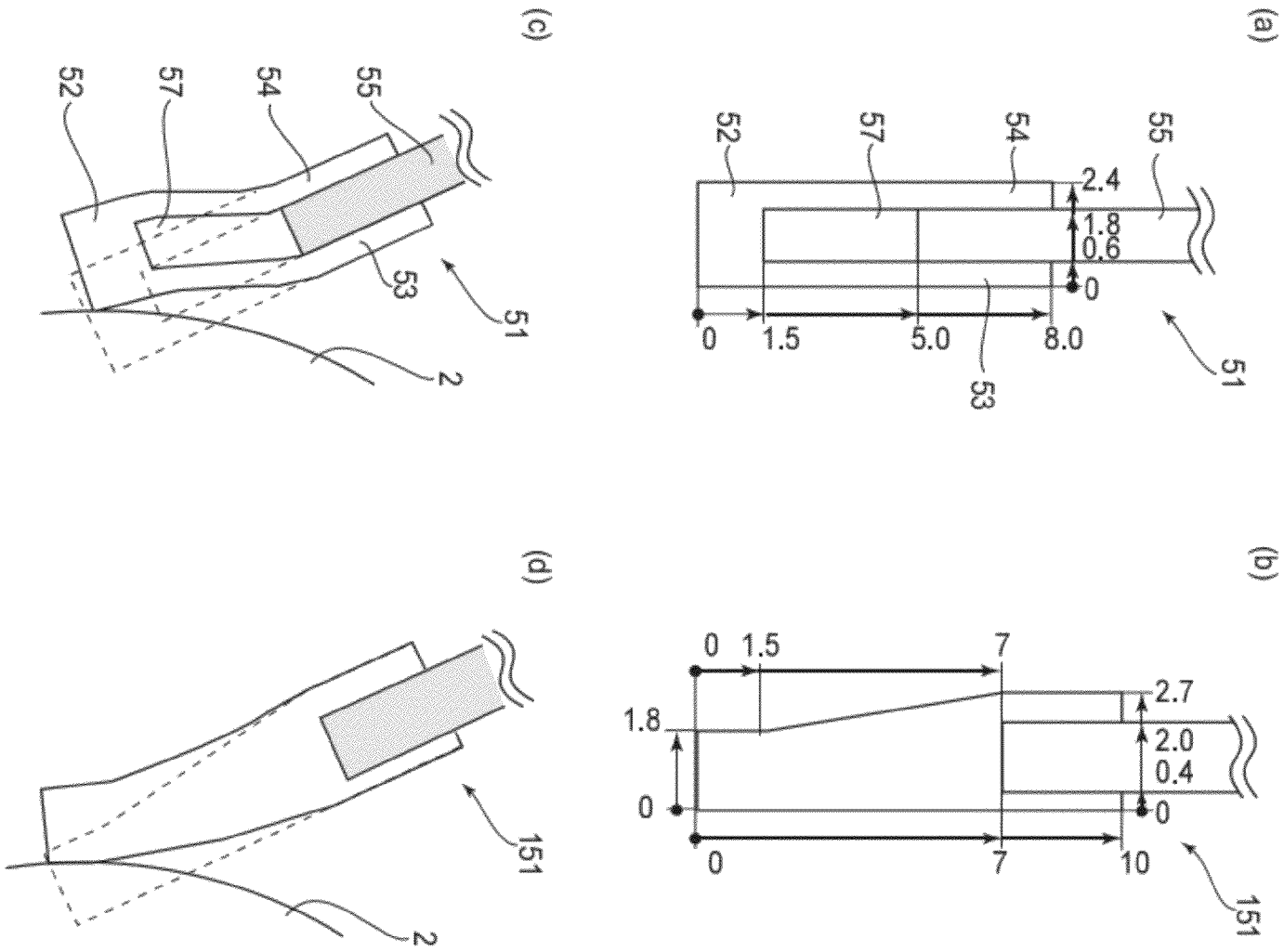
FIGS. 4(*a*) to 4(*d*) are schematic sectional views each showing a cleaning member.

FIG. 4(*a*) is a schematic sectional view of the cleaning member 51 in this embodiment. In this embodiment, dimensions of respective portions are indicated in FIG. 4(*a*) (unit: mm). The dimensions of the respective portions are determined on the basis of a point 0 and correspond to lengths from the point 0.

In this embodiment, a metal plate is used as the supporting portion 55, and as the contact portion 52, the image connecting portion 53 and the second connecting portion 54, urethane rubber as an integrally formed (molded) rubber material (elastic rubber member) in a substantially U-shape is used. The urethane rubber integrally formed in the substantially U-shape is bonded to the supporting portion 55 to prepare the cleaning member 51 having a hollow shape. For comparison, as a conventional embodiment, a cleaning member 151 prepared by using the same urethane rubber is shown in FIG. 4(*b*) together with dimensions of respective portions.

FIG. 4(C) is a schematic view showing a deformation state when the cleaning member 51 in this embodiment is disposed in contact with the photosensitive drum 2 of 24 mm in diameter under the setting condition including the set angle of 25 degrees and the entering amount of 1.5 mm. The deformation of the cleaning member 51 principally appears at a position in which the first connecting portion 53 and the second connecting portion 54 are deformed substantially parallel to each other, and the contact portion 52 contacts the surface of the photosensitive drum 2 in a state in which the contact portion 52 substantially keeps the set angle in the unloaded state (broken line). In other words, as the cleaning member 51 enters the photosensitive drum 2, the second connecting portion 54 functions as a supporting bar to suppress a change in contact angle of the contact portion 52 due to deformation of the first connecting portion 53 and the contact portion 52 in a direction in which the contact angle is decreased.

On the other hand, a deformation state in the case where the cleaning member 51 in the conventional embodiment is contacted to the photosensitive drum 2 under the same condition is shown in FIG. 4(*d*). The conventional cleaning member 151 is basically formed in a single plate shape, so that the contact portion is deformed in the direction in which the contact angle is decreased as the cleaning member 151 enters the photosensitive drum 2.

Figure 5:
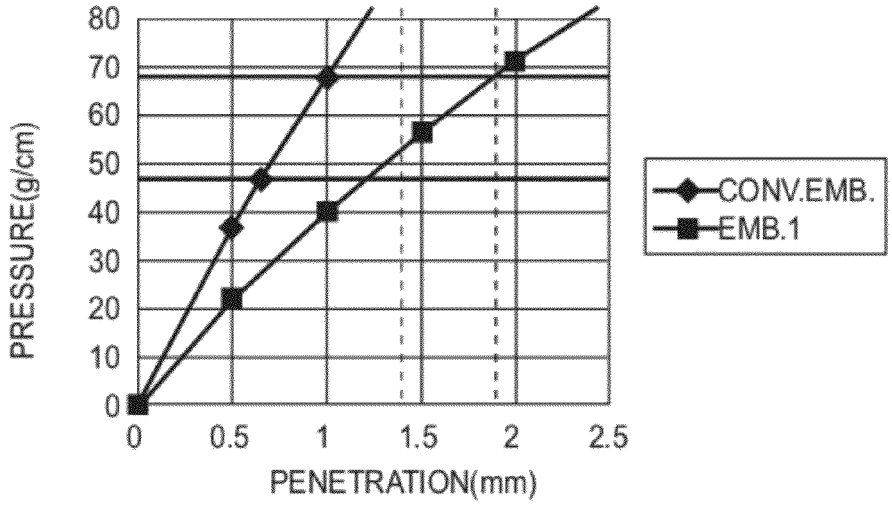
FIG. 5(*a*) is a graph showing a result of measurement of a contact pressure while changing an entering amount (penetration depth), and FIG. 5(*b*) is a graph showing a result of measurement of a contact angle while changing the entering amount.
Figure 5:
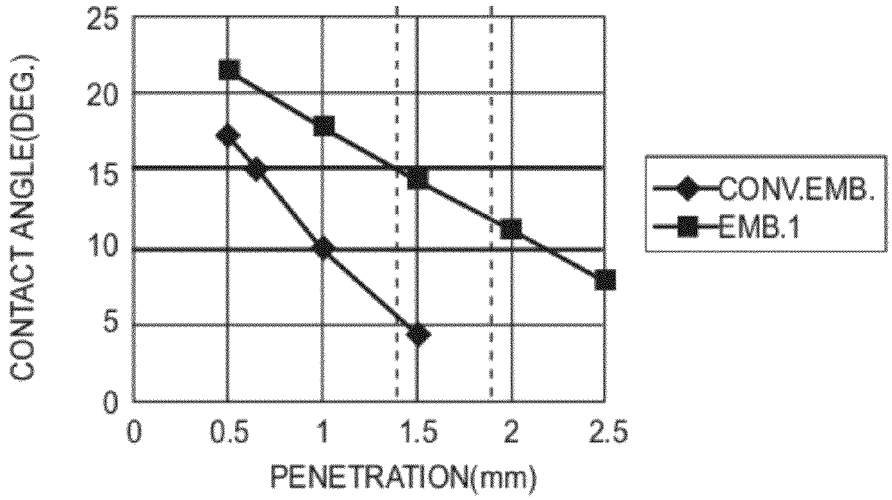

A result of measurement of a change in contact while actually changing the entering amount is shown in FIG. 5(*a*) and a result of measurement of a change in contact angle while actually changing the entering amount is shown in FIG. 5(*b*).

In the case of the image forming apparatus in this embodiment, in a range in which good cleaning can be performed, the contact pressure is 47 g/cm or more and 68 g/cm or less and the contact angle is 10 degrees or more and 15 degrees or less. The setting condition satisfying this contact condition is such that the set angle is 25 degrees and the entering amount is 0.7 mm or more and 1.0 mm or less, i.e., the range of a difference in entering amount of 0.3 mm in the conventional embodiment ("CONV. EMB."). On the other hand, in the case of this embodiment ("EMB. 1"), the setting condition is enlarged so that the set angle is 25 degrees and the entering amount is 1.4 mm or more and 1.9 mm or less, i.e., the range of a difference in entering amount of 0.5 mm. A result of a print test actually conducted is shown in Table 1.

TABLE 1

| EMB. | SA*1 (DEG.) | EA*2 (mm) | CP*3 |
|---|---|---|---|
| EMB. 1 | 25 | 1.3 | x |
| | 25 | 1.4 | ○ |
| | 25 | 1.9 | ○ |
| | 25 | 2 | x |
| CONV. | 25 | 0.6 | x |
| EMB. | 25 | 0.7 | ○ |
| | 25 | 1 | ○ |
| | 25 | 1.1 | x |

*1"SA" represents the set angle (degrees).
*2"EA" represents the entering amount (mm).
*3"CP" represents a cleaning property.

The range in which the good cleaning can be effected is 0.3 mm as the difference in entering amount of 0.7 mm or more and 1.0 mm or less in the conventional embodiment. On the other hand, in this embodiment, it is understood from Table 1 that the range is enlarged to 0.5 mm as the difference in entering amount of 1.4 mm or more and 1.9 mm or less. Further, a cross-sectional area of the rubber portion was 23.2 $mm^2$ in the conventional embodiment and was 19.2 $mm^2$ in this embodiment, so that the cleaning member in this embodiment was able to be downsized to about 80% of the conventional cleaning member.

As described above, according to the cleaning member in this embodiment, it is possible to realize downsizing and good cleaning performance.

Embodiment 2

In this embodiment, different from Embodiment 1, the thickness of the first connecting portion 3 is changed. In the following description, a difference in constitution from Embodiment 1 will be described and the same constitution as Embodiment 1 will be omitted from the description.

Figure 6:
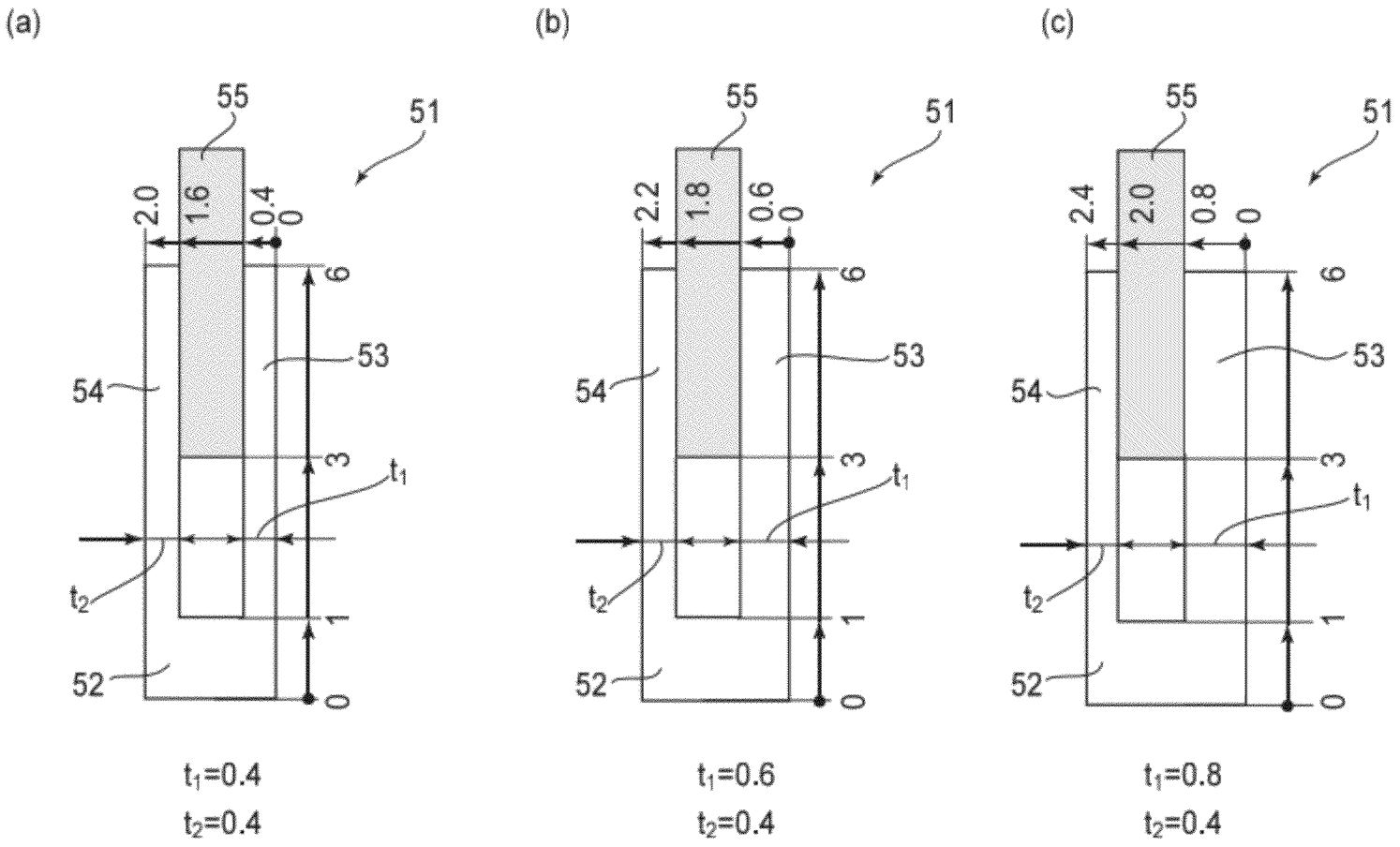
FIGS. 6(*a*) to 6(*c*) are schematic sectional views each showing a cleaning member in Embodiment 2.

FIGS. 6(*a*) to 6(*c*) are schematic views each showing the cleaning member 51 in this embodiment. In FIG. 6(*a*), the thickness of the first connecting portion is t1=0.4 mm and the thickness of the second connecting portion is t2=0.4 mm, i.e., t1=t2. In FIGS. 6(*b*) and 6(*c*), the thickness t1 is increased to 0.6 mm and 0.8 mm, respectively, while keeping the thickness t2 of 0.4 mm. In these figures, dimensions (unit: mm) of the respective portions are indicated similarly as in FIGS. 4(*a*) and 4(*b*).

Figure 7:
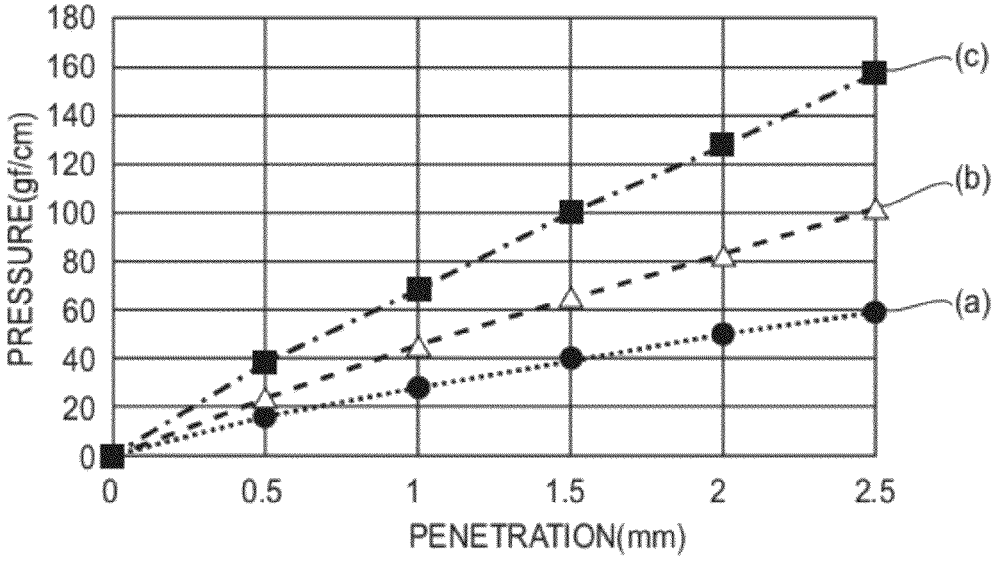
FIG. 7 is a graph showing changes in contact pressure with the entering amounts of the cleaning members shown in FIGS. 6(*a*) to 6(*c*).
Figure 8:
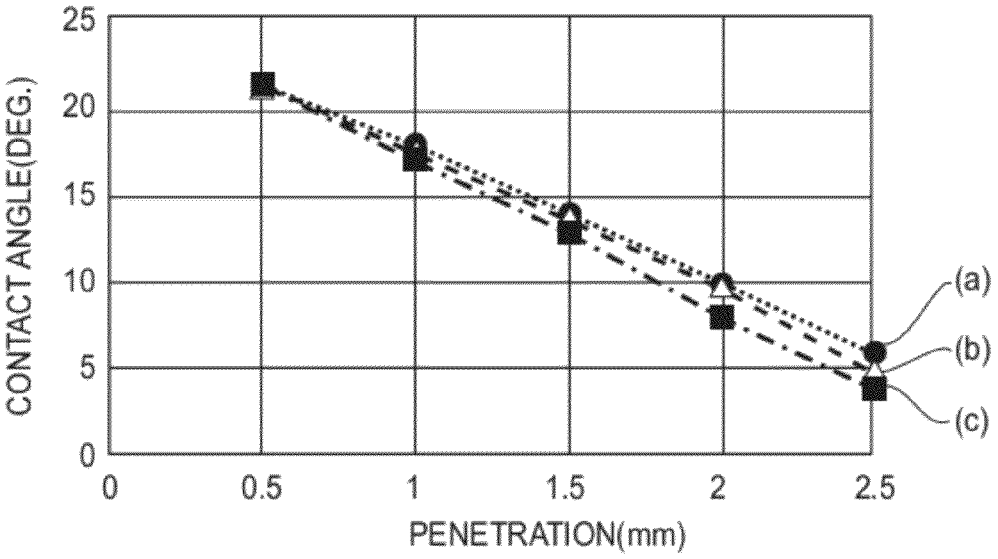
FIG. 8 is a graph showing changes in contact angle with the entering amounts of the cleaning members shown in FIGS. 6(*a*) to 6(*c*).

FIG. 7 is a graph showing a result of measurement of a change in contact pressure with the entering amount of the cleaning members 51 shown in FIGS. 6(*a*), 6(*b*) and 6(*c*). FIG. 8 is a graph showing a result of measurement of a change in contact angle with the entering amount of the cleaning members 51 shown in FIGS. 6(*a*), 6(*b*) and 6(*c*).

As shown in FIG. 7, the contact pressures with respect to the entering amounts of the cleaning members 51 shown in FIGS. 6(*a*), ("(*a*)"), 6(*b*) ("(*b*)") and 6(*c*) ("(*c*)") are understood that the contact of the cleaning member 51 can be increased by increasing the thickness of the first connecting portion 53. Further, as shown in FIG. 8, the contact angle with respect to the entering amount does not so depend on the thickness of the first connecting portion 53. As described in this embodiment, by adjusting the thicknesses of the first connecting portion 53 and the second connecting portion 54 as desired, it is possible to select the shape of the cleaning member 51 capable of obtaining a desired contact pressure.

Incidentally, in Embodiments 1 and 2, the urethane rubber as the number material (elastic rubber member) integrally formed in the substantially U-shape was used. Therefore, in an area in which the developer image is formed, when the cross section of the elastic blade portion 58 is taken in a direction perpendicular to the longitudinal direction, a hollow area 57 is always present at any direction. However, the present invention is not limited thereto. For example, in the case where the shape of the elastic blade portion 58 becomes unstable by the hollow area 57, with respect to a part of the longitudinal direction, a reinforcing portion for reinforcing the first connecting portion 53 and the second connecting portion 54 may be provided. At a position in which the reinforcing portion is present, when the cross section is taken in the direction perpendicular to the longitudinal direction, the hollow area 57 is not present in the cross section. However, in view of the effect of the present invention, a state in which the hollow area 57 is provided along the longitudinal direction is preferred.

Further, in Embodiments 1 and 2, the hollow area 57 defined by the supporting portion 55, the contact portion 52, the first connecting portion 53 and the second connecting portion 54 is described but the present invention is not limited thereto. In the hollow area 57, a material softer than that constituting the contact portion 52, the first connecting portion 53 and the second connecting portion 54 may be provided. For example, a foam(ed) member capable of volume change may be provided in the hollow area 57. Softness (hardness) can be measured by using a known rubber hardness meter (e.g., an Asker-C hardness meter). Further, in the case where a measuring portion is small, e.g., a piece of a sample having a 1 cm-cubic shape may be prepared and subjected to the measurement of the softness.

By using such a foam member, the cleaning member 51 and the members constituting the cleaning member 51 can be treated during manufacturing since the foam member functions as a back-up member (reinforcing member) for the contact portion 52, the first connecting portion 53 and the second connecting portion 54. For this reason, an effect of stably ensuring dimension accuracy of the cleaning member 51 can be achieved.

Further, as the longitudinal end portions of the cleaning member 51, the area 57 defined by the supporting portion 55, the contact portion 52, the first connecting portion 53 and the second connecting portion 54 may preferably be blocked so that the area 57 is configured as a closed space but the present invention is not limited thereto. In the case where the area 57 is not blocked at the longitudinal end portions of the elastic blade portion 58, a member for blocking the area 57 may be separately provided on the image forming apparatus main assembly side. As a result, by mounting the cleaning member 51 into the image forming apparatus main assembly, the area 57 is blocked, so that it is possible to suppress the toner to enter the area 57.

Further, in Embodiments 1 and 2, the first connecting portion 53 and the second connecting portion 54 are provided in substantially parallel to each other in the unloaded state but the present invention is not limited thereto. The first and second connecting portions 53 and 54 may also be constituted so that a distance (spacing) therebetween on the contact portion 52 side is smaller than that on the supporting portion 55 side. Further, the first and second connecting portions 53 and 54 may also be constituted so that the distance therebetween is gradually decreased from the supporting portion 55 toward the contact portion 52. That is, the first and second connecting portions 53 and 54 may be configured so that the deformation of the contact portion 52 in the direction in which the contact angle is decreased as the cleaning member 51 enters the photosensitive drum 2 is suppressed by providing the second connecting portion 54.

Incidentally, in the embodiments described above, the image forming apparatus of the type in which the toner image is directly transferred from the photosensitive drum onto the recording material 7 is described but the present invention is not limited thereto. It is also possible to form an image on the recording material 7 by employing the image forming apparatus of the type in which the toner image is transferred from the photosensitive drum 2 onto an intermediary transfer member (toner image receiving member) and then is transferred from the intermediary transfer member onto the recording material 7.

INDUSTRIAL APPLICABILITY

According to the present invention, it is possible to provide a cleaning member capable of realizing downsizing and stable and good cleaning performance.

While the invention has been described with reference to the structures disclosed herein, it is not confined to the details set forth and this application is intended to cover such modifications or changes as may come within the purpose of the improvements or the scope of the following claims.

The invention claimed is:

1. A cleaning member, for use in an image forming apparatus in which a developer image formed on an image bearing member is to be transferred onto a developer image receiving member to form an image, for removing developer remaining on the image bearing member after developer image transfer, said cleaning member comprising:

an elastic blade portion, having flexibility and being provided counterdirectionally with respect to a rotational direction of the image bearing member, for removing developer remaining on the image bearing member, by contacting the image bearing member in a bent state when said cleaning member is used in the image forming apparatus; and a supporting portion for supporting said elastic blade portion, wherein said elastic blade portion includes, in a cross-section perpendicular to a longitudinal direction of said elastic blade portion at a position in which the developer image is to be formed with respect to the longitudinal direction, a contact portion that contacts the image bearing member when said cleaning member is used in the image forming apparatus, a first connecting portion that connects the contact portion and a portion of said supporting portion close to the image bearing member, and a second connecting portion that connects the contact portion and a portion of said supporting portion remote from the image bearing member, wherein said supporting portion, the contact portion, the first connecting portion, and the second connecting portion define a hollow area, and wherein the first and second connecting portions include a same rubber material.

2. A cleaning member according to claim 1, wherein the contact portion, the first connecting portion, and the second connecting portion are integrally formed of the same rubber material.

3. An image forming apparatus comprising:

an image bearing member; and a cleaning member, according to claim 1, for removing developer remaining on the image bearing member after developer image transfer.

4. A cleaning member, for use in an image forming apparatus in which a developer image formed on an image bearing member is to be transferred onto a developer image receiving member to form an image, for removing a developer remaining on the image bearing member after developer image transfer, said cleaning member comprising:

an elastic blade portion, having flexibility, for removing developer remaining on the image bearing member, by contacting the image bearing member in a bent state when said cleaning member is used in the image forming apparatus; and a supporting portion for supporting said elastic blade portion, wherein said elastic blade portion includes, in a cross-section perpendicular to a longitudinal direction of said elastic blade portion at a position in which the developer image is to be formed with respect to the longitudinal direction, (i) a contact portion that contacts the image bearing member when said cleaning member is used in the image forming apparatus, (ii) a first connecting portion that connects the contact portion and a first contact portion-side end portion of said supporting portion close to the image bearing member, (iii) a second connecting portion that connects the contact portion and a second contact portion-side end portion of said supporting portion remote from the image bearing member, and (iv) a foam member provided in an area defined by said supporting portion, the contact portion, the first connecting portion, and the second connecting portion, wherein the foam member is softer than the first connecting portion and the second connecting portion, and wherein the first and second connecting portions include a same rubber material.

5. A cleaning member according to claim 4, wherein the contact portion, the first connecting portion, and the second connecting portion are integrally formed of the same rubber material.

6. A cleaning member according to claim 4, wherein said elastic blade portion is provided counterdirectionally with respect to a rotational direction of the image bearing member.

7. An image forming apparatus comprising:

an image bearing member; and a cleaning member, according to claim 4, for removing developer remaining on said image bearing member after developer image transfer.

8. A cleaning member according to claim 1, wherein a U-shape is formed by the contact portion, the first connecting portion, and the second connecting portion.

9. A cleaning member according to claim 1, wherein said supporting portion comprises a metal plate.

10. A cleaning member according to claim 4, wherein a U-shape is formed by the contact portion, the first connecting portion, and the second connecting portion.

11. A cleaning member according to claim 4, wherein said supporting portion comprises a metal plate.

* * * * *